US007707668B2

(12) United States Patent
Kloes et al.

(10) Patent No.: US 7,707,668 B2
(45) Date of Patent: May 4, 2010

(54) SUPPORT PILLOW FOR RELIEVING PRESSURE ON MUSCLES, TENDONS, AND BLOOD VESSELS AND METHOD THEREFOR

(76) Inventors: Janine Kloes, 355 Shamrock La., Grants Pass, OR (US) 97527; James Kloes, 355 Shamrock La., Grants Pass, OR (US) 97527

( * ) Notice: Subject to any disclaimer, the term of this patent is extended or adjusted under 35 U.S.C. 154(b) by 0 days.

(21) Appl. No.: 12/368,149

(22) Filed: Feb. 9, 2009

(65) Prior Publication Data

US 2009/0211031 A1 Aug. 27, 2009

Related U.S. Application Data

(60) Provisional application No. 61/030,793, filed on Feb. 22, 2008.

(51) Int. Cl.
*A47C 20/00* (2006.01)

(52) U.S. Cl. ..... 5/636; 5/637; 5/639

(58) Field of Classification Search ..... 5/636, 5/637, 640, 645, 652; D6/595–599, 601, D6/604

See application file for complete search history.

(56) References Cited

U.S. PATENT DOCUMENTS

D94,702 S 2/1935 Marks
2,167,622 A * 8/1939 Bentivoglio ..... 5/636
2,199,479 A * 5/1940 Cappel ..... 5/637
2,336,707 A 12/1943 Thompson
2,940,088 A 6/1960 Boos
3,667,074 A 6/1972 Emery
4,236,264 A 12/1980 Britzman
4,375,112 A 3/1983 Leonhar
4,788,728 A 12/1988 Lake
5,088,141 A 2/1992 Meyer et al.
5,363,524 A 11/1994 Lang
5,708,998 A 1/1998 Torbik
D410,810 S 6/1999 Lozier
D420,845 S 2/2000 Rumage
D456,516 S 4/2002 Cheshack et al.
6,457,195 B1 10/2002 Holste
6,931,682 B2 8/2005 Krueger, Jr.
7,082,633 B1 * 8/2006 Maarbjerg ..... 5/636
2002/0050007 A1 5/2002 Kim
2006/0016011 A1 1/2006 Berg

* cited by examiner

*Primary Examiner*—Peter M Cuomo
*Assistant Examiner*—Nicholas Polito

(57) ABSTRACT

A pillow for relieving pressure on a neck of a user. In one embodiment, the pillow includes a body section, a first lobe member integrally bound to the body section and adaptable for supporting a nape of a neck of a user, and a second lobe member integrally bound to the body section and adaptable for supporting a cheek bone and a jaw of the user. The pillow also includes a channel formed in the body section between the first lobe member and the second lobe member, wherein the channel is adaptable for receiving the neck of the user to relieve pressure on the neck of the user.

5 Claims, 5 Drawing Sheets

SUPPORT PILLOW FOR RELIEVING PRESSURE ON MUSCLES, TENDONS, AND BLOOD VESSELS AND METHOD THEREFOR

CROSS REFERENCES TO RELATED APPLICATIONS

This application claims the benefit of the following provisional patent application, which is hereby incorporated by reference as if set forth in full in this specification for all purposes: U.S. Patent Application Ser. No. 61/030,793, entitled "A SUPPORT PILLOW FOR RELIEVING PRESSURE ON MUSCLES, TENDONS AND BLOOD VESSELS AND METHOD THEREFOR," filed on Feb. 22, 2008. This application is related to a design patent application illustrating a pillow, and having Ser. No. 29/310,057, filed Jul. 24, 2008.

FIELD OF THE INVENTION

This invention relates generally to a pillow, and more specifically, to a pillow that is designed to eliminate the pressure on the muscles, tendons, and blood vessels on the side of the neck when a person is sleeping on his/her side.

BACKGROUND

A pillow is a bag or case made of cloth that is filled with feathers, down, other soft material, or a solid piece or pieces of resilient material such as latex foam or memory foam. The pillow is designed to cushion the head when one is sleeping or resting. Conventional pillows include ordinary rectangular pillows, and pillows having a raised ridge, roll, hump, or tubular padding along the front edge which is intended to support the neck.

Conventional rectangular pillows have been in use for many years. However, this type of pillow provides little support for the spine and shoulders of the user.

With regard to conventional pillows with a raised portion, these types of pillows are intended to support the neck of the user. These types of pillows are a more recent innovation and can be effective when the sleeper is in a back-reclined or supine position. However, such pillows can put undue pressure on the blood vessels, muscles, and tendons of the neck when a user is sleeping on his/her side.

Within what is termed the carotid triangle (an area of the neck defined by muscles which includes the carotid artery and the jugular vein) gentle pressure can be applied to the external carotid artery to determine the presence of a pulse. The pulsations of the heart are easily felt within the carotid triangle because the external carotid is essentially only covered by skin and superficial fascia. Accordingly, the external carotid is easily felt (palpated) and is highly vulnerable to external pressure and injury. It has been said the amount of pressure needed to close the blood vessels of the neck can be as little as 4 pounds. The head of an adult weighs approximately 10 to 12 pounds.

Recent studies have shown the pressure on the blood vessels of the neck from a tight necktie is linked to increased glaucoma risk by increasing intraocular pressure (pressure inside the eye). It has also been suggested that pressure on these blood vessels may cause or contribute to plaque deposits in the blood vessels of the neck, and also to Alzheimer's disease.

Additionally, pressure on the carotid sinus (an area within the carotid artery near the branch point) may result in a severe and prolonged period of unconsciousness. This syndrome is called carotid sinus syndrome or carotid sinus syncope (fainting). Syncope may result from stimulation of the carotid sinus pressure sensors by turning the head to one side, by a tight collar, or even by shaving over the region of the sinus in the neck. When the carotid sinus senses pressure, either blood pressure or external pressure, it may send a signal to slow the heart rate or decrease the blood pressure without slowing the heart rate. Pressure on the carotid structure may thus affect the heart rhythms and result in reflex cardiac arrest.

In a sleeping person, a period of unconsciousness would most likely go unnoticed, but the muscles located on the side of the neck are also quite tender. When sleeping on one's side, conventional pillows may exert various amounts of pressure on those muscles, tendons, and the blood vessels located alongside. The weight of the head and neck on some conventional pillows can be noticeably uncomfortable and may be injurious to one's health as well.

Therefore, a need exists to provide a device and method to overcome the above problem.

A further understanding of the nature and the advantages of particular embodiments disclosed herein may be realized by reference of the remaining portions of the specification and the attached drawings.

SUMMARY

Embodiments of the present invention provide a pillow and method for relieving pressure on a neck of a user. In one embodiment, the pillow includes a body section, a first lobe member integrally bound to the body section and adaptable for supporting a nape of a neck of a user, and a second lobe member integrally bound to the body section and adaptable for supporting a cheek bone and a jaw of the user. The pillow also includes a channel formed in the body section between the first lobe member and the second lobe member, wherein the channel is adaptable for receiving the neck of the user to relieve pressure on the neck of the user.

These provisions, together with the various ancillary provisions and features which will become apparent to those skilled in the art as the following description proceeds, are attained by the methods and assemblies of embodiments of the present invention.

BRIEF DESCRIPTION OF THE DRAWINGS

Common reference numerals are used throughout the drawings and detailed description to indicate like elements.

DETAILED DESCRIPTION OF EMBODIMENTS

Figure 1:
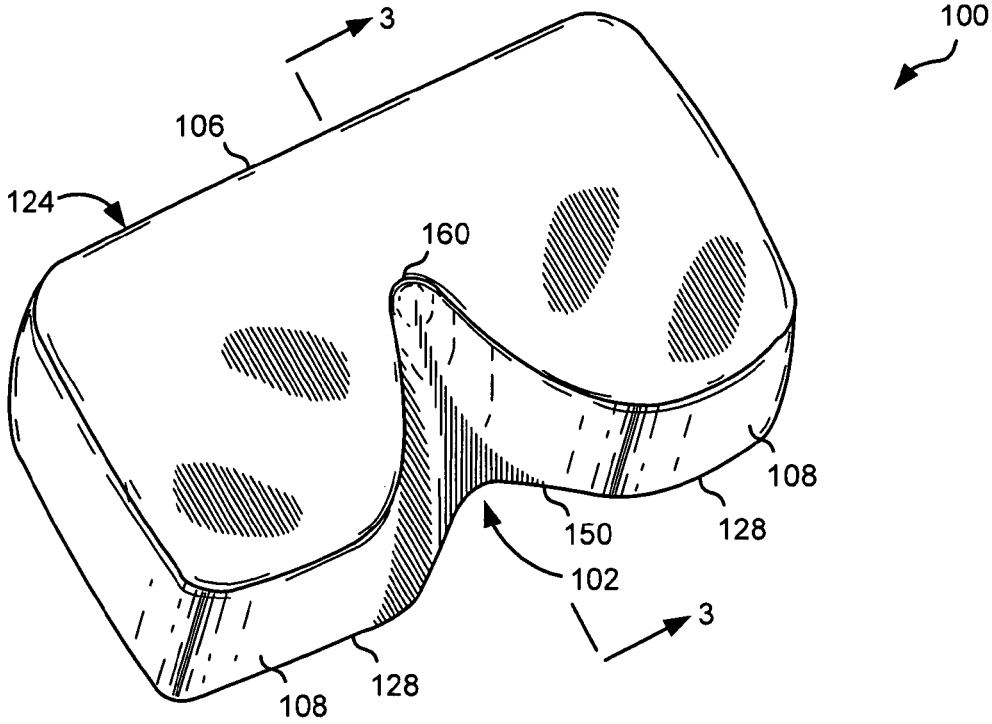
FIG. 1 shows an elevated perspective view of a pillow in accordance with one embodiment.

In the description herein, numerous specific details are provided, such as examples of components and/or methods, to provide a thorough understanding of the embodiments of the present invention. One skilled in the relevant art will recognize, however, that embodiments of the invention may be practiced without one or more of the specific details, or with other apparatus, systems, assemblies, methods, components, materials, parts, and/or the like. In other instances, well-known structures, materials, or operations are not specifically shown or described in detail to avoid obscuring aspects of the embodiments of the present invention.

FIGS. 1-4 illustrate a pillow 100 according to one embodiment. As described in more detail below, the pillow 100 is designed to eliminate the pressure on the muscles, tendons, and blood vessels on the side of the neck 104 when a user is sleeping on his/her side as opposed to sleeping on his/her back or stomach. The pillow 100 uses a channel 102 to receive the sleeper's neck 104 and to prevent pressure on the blood vessels, tendons, and muscles on the side of the neck 104 of the user.

The pillow 100 has a main body unit 106 which includes a bottom 120. In particular embodiments, the main body unit 106 is of a somewhat greater thickness than generally found in conventional pillows. This serves to reduce body weight on the shoulder 112 that is in contact with the sleeping surface, thereby allowing the relaxation of the muscles of the neck 104 and shoulder 112 as is explained below.

The main body unit 106 may come in different shapes and sizes. In the embodiment shown in FIGS. 1-4, the main body unit 106 has a rectangular shape. However, this is just shown as one example and should not be seen as to limit the scope of the present invention. The main body unit 106 may be formed of a cushion material. Feathers, down, fiberfill, or other soft material may be used. A resilient foam, memory foam or a latex foam may also be used and may include a single piece or several pieces or layers combined to achieve the desired shape.

The pillow may be constructed to contain air, water, gel or any other material. The listing of the above materials is given as an example and should not be seen as to limit the scope of the present invention. If the filling material is comprised of loose material or if multiple pieces of material are used, the main body unit 106 may have a cover which prevents the material of the main body unit 106 from becoming loose, and further prevents the material of the main body unit from getting dirty. Alternatively, if the pillow 100 is manufactured from a solid piece of foam or cohesive material, a cover is not necessary but may be included to prevent the material from getting dirty. The main body unit 106 may also be sculptured, have raised or lowered areas or have a textured surface such as an "egg crate" texture. The pillow 100 may be constructed with elastic material within the pillow 100 or along a seam or seams as a full or partial covering. Additionally, baffles or compartments may be added.

In one embodiment, a channel 102 is formed in the main body unit 106. In one embodiment, the channel 102 is formed in a central area of the main body unit 106 and extends in a downward direction. In the embodiment shown in FIGS. 1-4, the channel 102 runs in a downward and outward direction. For example, in one embodiment, the channel 102 slopes such that the upper end of the channel 102 is closer to the center of mass of the main body unit 106 (and further from the ends of the lobes 108) relative to the lower end of the channel 102. As such, the slope of the channel 102 generally follows the contour of the user's neck 104 when placed inside the channel 102, thereby eliminating or minimizing any pressure that the pillow may exert on the neck 104. In general, a substantial amount of the material in the channel 102 may be removed. This allows the channel 102 to serve as a pressure-free area in which the blood vessels, muscles and tendons of the sleeper's neck 104 are not compressed by any material while sleeping. Alternatively, the channel 102 may be formed in a sloping manner. In this embodiment, the channel 102 slopes in a downward direction so that the portion of the channel 102 at the bottom section of the main body unit 106 is lower than in the central area of the main body unit 106. Material toward the bottom section of the main body unit 106 may also be removed. This would allow the shoulder 112 of the sleeper to engage the channel 102 while the main body unit 106 gently supports the head 110 of the sleeper. This alleviates pressure on the sleeper's neck 104 so that the blood vessels, muscles, and tendons of the sleeper's neck are not restricted.

Figure 2:
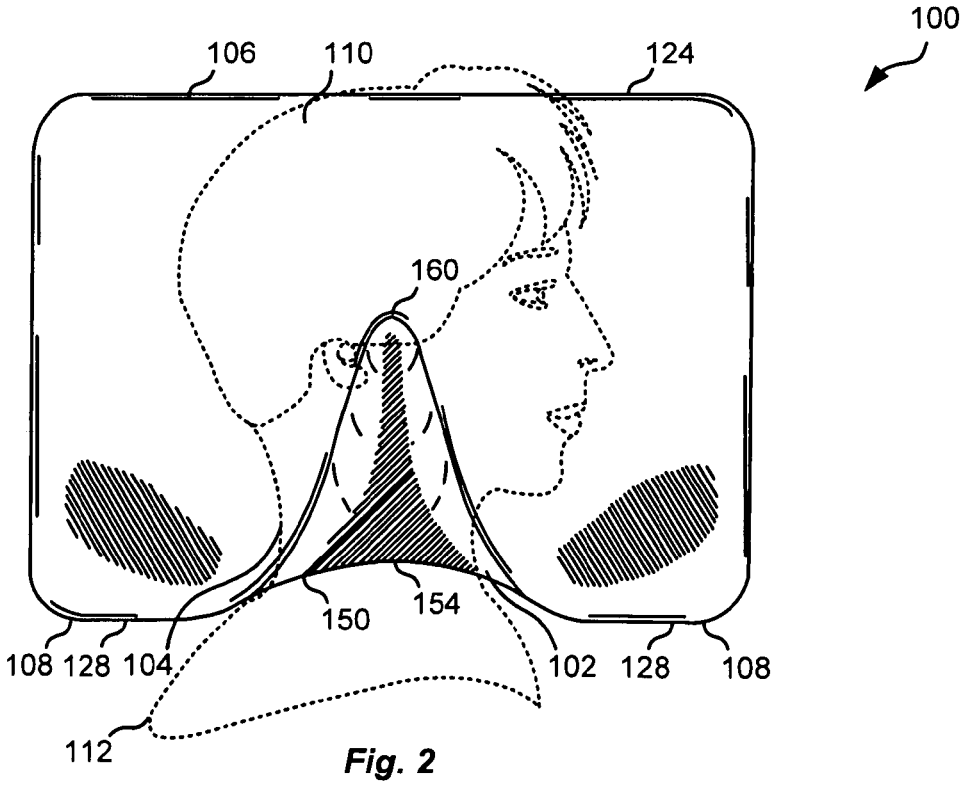
FIG. 2 shows a top view of the pillow of FIG. 1 with the head of a user resting on the pillow.
Figure 3:
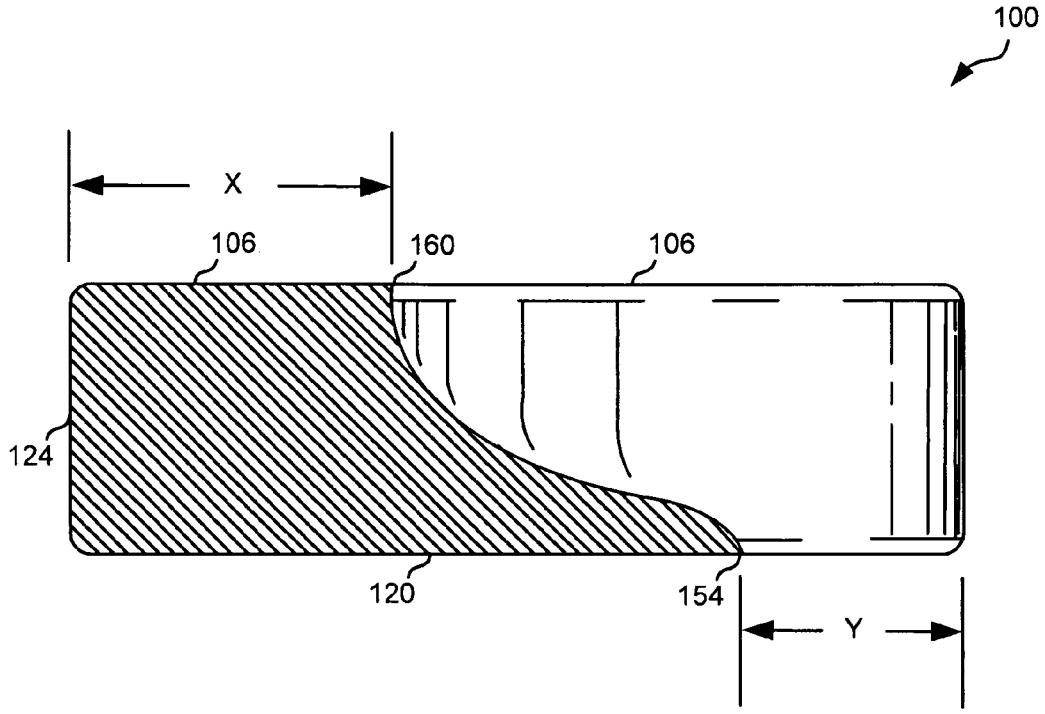
FIG. 3 is a vertical sectional view taken in the direction of the arrows and along the plane of line 3-3 in FIG. 1.
Figure 4:
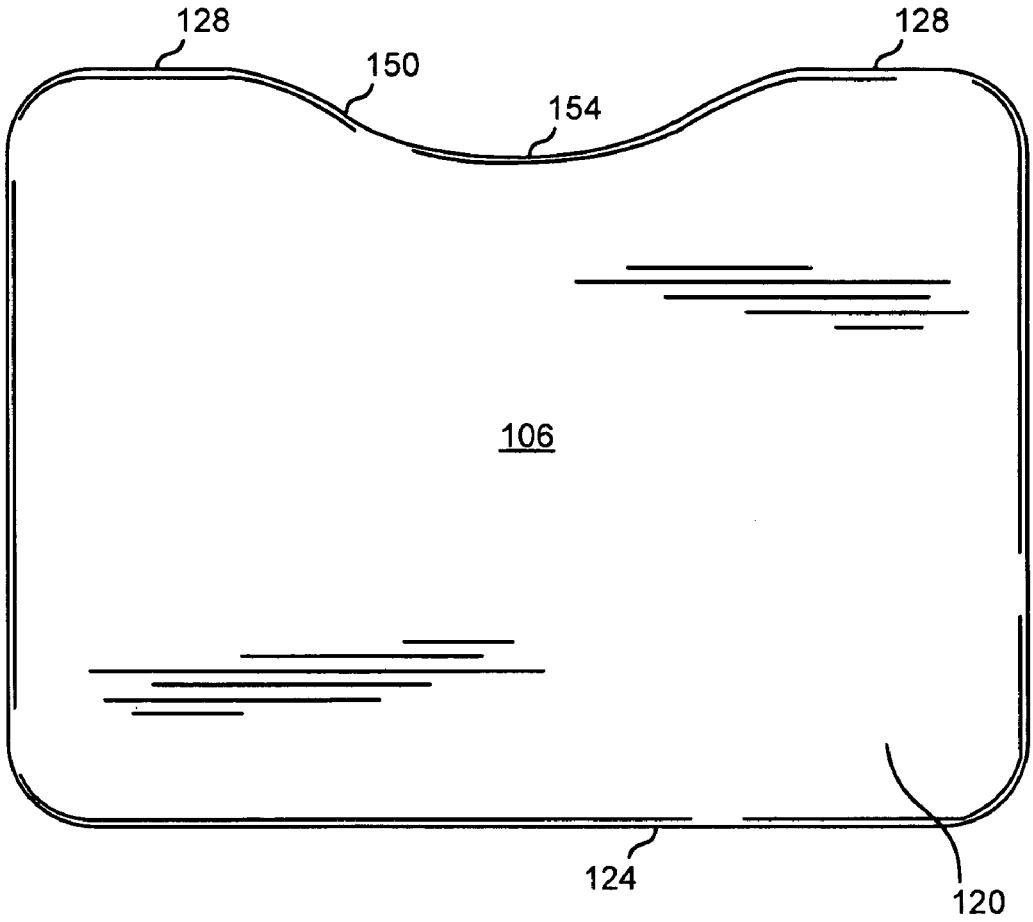
FIG. 4 is a bottom plan view of the pillow.
Figure 5:
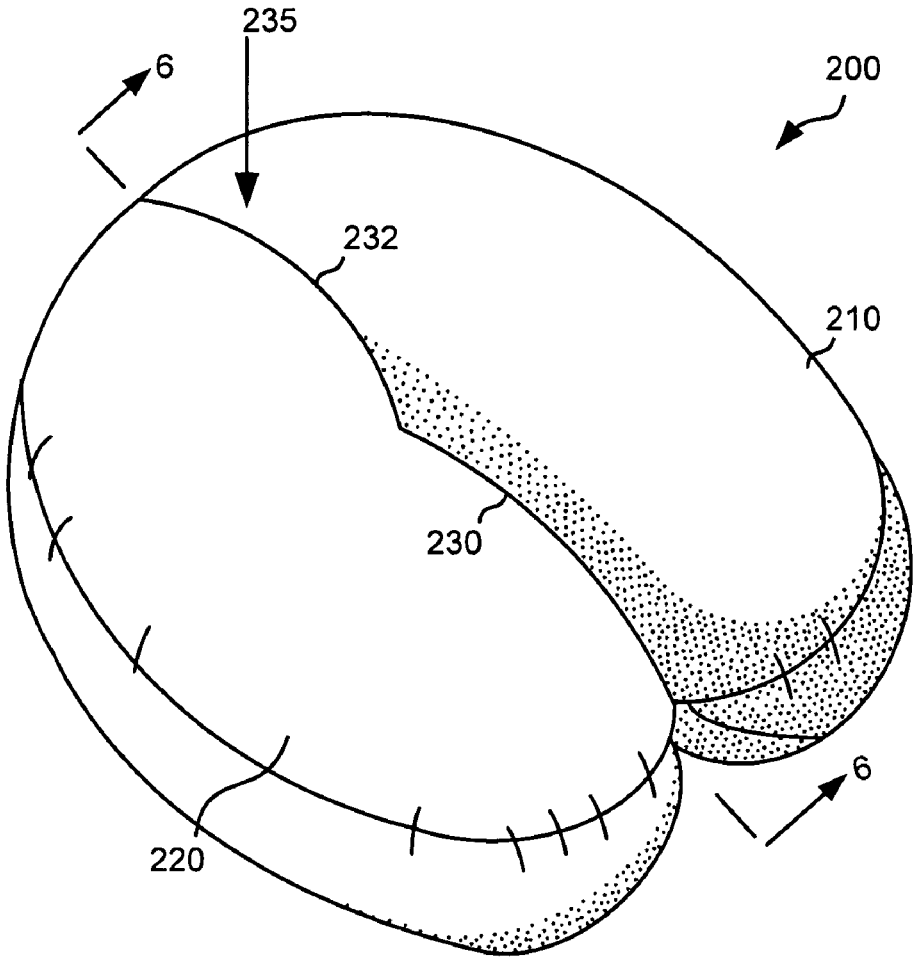
FIG. 5 is a perspective view of another embodiment of the pillow.
Figure 6:
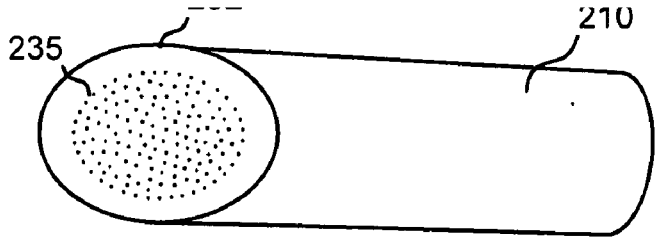
FIG. 6 is a vertical sectional view taken in the direction of the arrows and along the plane of line 6-6 in FIG. 5.
Figure 8:
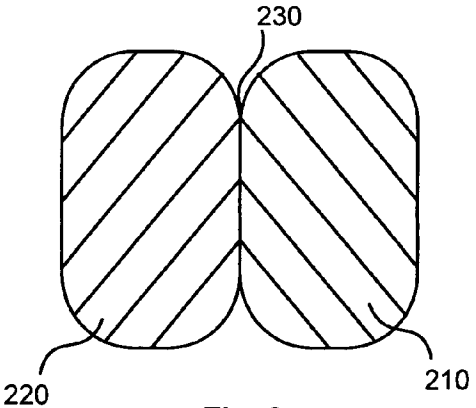
FIG. 8 is a vertical sectional view taken in the direction of the arrows and along the plane of line 8-8 in FIG. 7.
Figure 7:
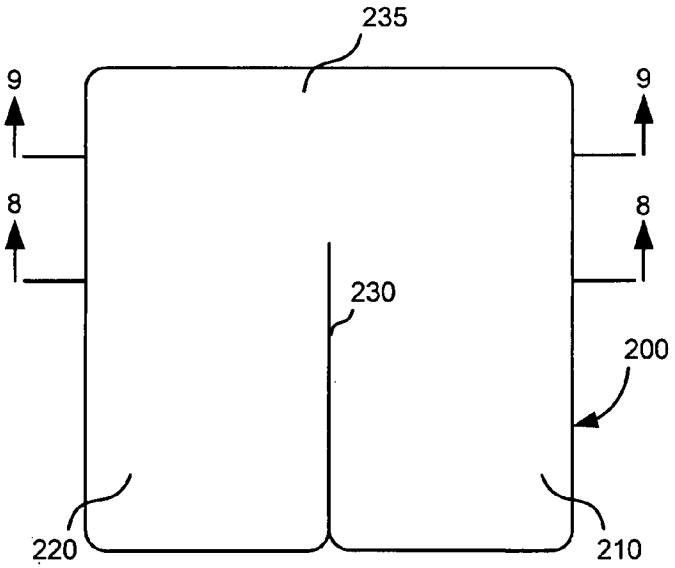
FIG. 7 is a top plan view of another embodiment of the pillow.
Figure 9:
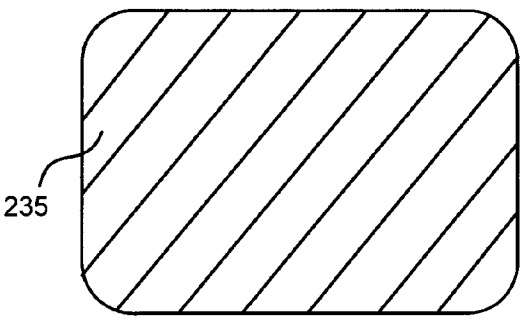
FIG. 9 is a vertical sectional view taken in the direction of the arrows and along the plane of line 9-9 in FIG. 7.

The shape of the channel 102 may vary depending on the material used to make the pillow 100. For example, as shown in FIG. 2, in one embodiment, an upper termination end 160 of the channel 102 may be narrower than a lower termination end 150. As such, the channel 102 may have a conical shape, where the wider end (i.e., the lower termination end 150) may receive a shoulder 112 of the user may be placed partially into the opening of the channel 102. In other embodiments the channel 102 may be rounded on the top portion or it may be square, pointed, elliptical, etc. The shape of the channel 102 does not detract from the purpose of the pillow 100 which is to alleviate pressure on the blood vessels, tendons, and muscles on the side of the neck 104 when sleeping.

The channel 102 forms two lobes 108 in the main body unit 106 that extend downward from the main body unit 106. The lobes 108 are separate but located directly adjacent to each other and connect to the main body unit 106 in the central area of the main body unit 106. The two lobes 108 have respective lobe ends 128-128. In particular embodiments, the lobes 108 generally have approximately the same thickness as the main body unit 106 continuously to the ends of the lobes 108. If constructed from down, fiberfill or similar loose, soft material the lobes 108 may have a tubular shape. Alternatively, the lobes 108 may be tapered, flattened, enlarged, expanded, etc. toward the ends of the lobes 108. The lobes 108 may also be completely separate from each other with no connecting material between them.

In one embodiment, the channel 102 terminates at the upper termination end 160, and at the lower termination end 150, and the channel has a mid-end 154. In one embodiment, the upper termination end 160 may be defined as the upper end of the channel 102, and the lower termination end 150 may be defined as the lower end of the channel 102. As shown in FIGS. 1 and 2, the upper termination end 160 is within the main body unit 106, and the lower termination end 150 is at a portion of the lower edge of the main body unit 106. A distance X may be defined as the distance between the upper termination end 160 of the channel 102 and a plane along side 124 of the main body unit 106. A distance Y may be defined as the distance between mid-end 154 and the plane across the lobe ends 128-128. Distances X and Y may be any suitable distances. In one embodiment, distance X is greater than distance Y. In one embodiment, the distance between mid-end 154 and plane 124 is greater than the distance X. In other words, distance between the lower termination end 150 and the plane 124 is greater than distance between the upper termination end 160 and the plane 124. This differential causes channel 102 to slope downward away from the center of mass of the main body unit 106 and toward the ends of the lobes 108, which enables the channel 102 to generally follow the contour of the user's neck 104 when placed inside the channel 102, thereby eliminating or minimizing any pressure that the pillow may exert on the neck 104.

The inside facets of the lobes 108 may have several different appearances. The inside facets of the lobes 108 may be curved or sculptured, etc. or they may be straight horizontally or vertically to the ends, and may be of various lengths. The ends of the lobes 108 may be round, pointed, flat, tapered, bulbous, etc.; the shape of which would not detract from the purpose of the pillow 100, which is to alleviate pressure on the blood vessels, tendons, and muscles on the side of the neck 104 when sleeping.

As shown in FIG. 2, at least one portion of the lower termination end 150 may be offset from a plane across the first lobe end and the second lobe end. In one embodiment, the lower termination end is offset inwardly toward the main body unit 106.

In operation, a user may lie on one side of his/her body as opposed to sleeping on his/her back or stomach. When lying on the side of the body, the user places the neck 104 into the channel 102 and places the head 110 on the main body unit 106 of the pillow 100. Depending on the size of the user and the pillow 100, the shoulder 112 of the user may be placed in or slightly below the opening in the channel 102 located at the bottom section of the main body unit 106. In this position, the nape of the neck 104 and neck vertebrae are then supported by the lobe 108 at the rear of the head 110, while the cheek bone and jaw are supported by the lobe 108 at the front of the head 110. The skull is supported by the main body unit 106 of the pillow 100, thereby giving superior support to the head 110 and spine without any pressure on the blood vessels, tendons, and muscles on the side of the neck 104.

The pillow 100 is also very comfortable when sleeping on one's back in a supine position. The neck vertebrae would then engage the channel 102 and the lobes 108 on either side would give support to the neck 104 and shoulders 112 of the sleeper. When sleeping on one's stomach, the pillow 100 can also be utilized to reduce compression on the blood vessels, tendons and muscles on the side of the neck 104 by placing the neck 104 in the channel 102 while the head 110 and face are supported by the lobes 108 on either side.

Referring now to FIGS. 5-9, there is seen another embodiment of the pillow, generally illustrated as 200. In one embodiment, lobes 210 and 220 are separate and spaced from each other, but terminating in the body 235 of the pillow, which may include at least one score 232. In one embodiment, lobes 210 and 220 are in contact with each other but are capable of being pulled away from each other by the user during use of the pillow. Opening or slit 230 is formed between the lobes 210 and 220. As previously suggested, the pillow may possess any suitable stuffing, such as down, fiberfill, feathers, or the like. For the embodiment illustrated in FIGS. 5-9, pillow 200 is constructed of fiberfill.

Embodiments of the present invention provide a method for relieving pressure on a neck of the user through the use of a pillow. As indicated, the pillow comprises a body section. A channel is formed in the body section, and extends from a central area of the body section to a bottom section of the body section. The channel is used to accommodate the neck of the user to relieve pressure placed on the side of the neck. The channel more specifically extends in a downward and outward direction. A lobe member is formed on each side of the channel. A first lobe member supports the nape of the neck and a second lobe member supports the cheek bone and jaw. Each lobe member extends downward from the body section. The lobe members are respectively located directly adjacent to each other, and are connected to the body section in the center area of the body section.

Reference throughout this specification to "one embodiment", "an embodiment", or "a specific embodiment" means that a particular feature, structure, or characteristic described in connection with the embodiment is included in at least one embodiment of the present invention and not necessarily in all its embodiments. Therefore, the respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any arrows in the drawings/figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of the illustrated embodiments of the present invention and are to be included within the spirit and scope of the present invention.

Therefore, while the present invention has been described herein with reference to the particular embodiments thereof, a latitude of modification, various changes and substitutions are intended in the foregoing disclosures, and it will be appreciated that in some instances some features of the embodiments of the invention will be employed without the corresponding use of other features without departing from the scope and spirit of the invention as set forth. Therefore, many modifications may be made to adapt a particular situation or material to the essential scope and spirit of the present invention. It is intended that the invention not be limited to the particular terms used in the following claims and/or to the particular embodiment disclosed as the best mode contemplated for carrying out this invention, but that the invention will include any and all embodiments and equivalents falling within the scope of the appended claims.

We claim:

1. A pillow comprising: a body section; a first lobe member integrally bound to the body section and adaptable for supporting a nape of a neck of a user; a second lobe member integrally bound to the body section and adaptable for supporting a cheek bone and a jaw of the user; and a channel formed in the body section between the first lobe member and the second lobe member, wherein the channel is adaptable for receiving the neck of the user to relieve pressure on the neck of the user; wherein the channel extends from an upper termination end within the body section downward to a lower termination end at a lower edge and a bottom surface of the body section, wherein the first lobe member and the second lobe member respectively comprise a first lobe end and a second lobe end, wherein the lower termination end comprises at least one portion that is offset from a plane across the first lobe end and the second lobe end, and wherein the lower termination end is offset inwardly toward the body section.

2. The pillow of claim 1 wherein the channel comprises a slope that substantially follows a contour of the neck when the channel receives the neck.

3. The pillow of claim 1 wherein the channel slopes in a downward direction such that the lower termination end is lower than in a central area of the main body unit.

4. The pillow of claim 1 wherein the first and second lobe ends are adaptable to allow a shoulder of the user to engage the channel while the body section supports the head of the user.

5. The pillow of claim 1 wherein the first and second lobe members comprise approximately a same thickness as the body section.

* * * * *